US009808385B2

(12) United States Patent
Robertson

(10) Patent No.: US 9,808,385 B2
(45) Date of Patent: Nov. 7, 2017

(54) LIFT-RECLINER CHAIR

(71) Applicant: INTEGRATED FURNITURE TECHNOLOGIES LIMITED, Gloucestershire (GB)

(72) Inventor: Dale Robertson, Cheltenham (GB)

(73) Assignee: INTEGRATED FURNITURE TECHNOLOGIES LIMITED, Gloucestershire (GB)

( * ) Notice: Subject to any disclaimer, the term of this patent is extended or adjusted under 35 U.S.C. 154(b) by 20 days.

(21) Appl. No.: 14/845,354

(22) Filed: Sep. 4, 2015

(65) Prior Publication Data

US 2015/0374566 A1 Dec. 31, 2015

Related U.S. Application Data

(63) Continuation of application No. 13/818,678, filed as application No. PCT/GB2011/001329 on Sep. 9, 2011, now Pat. No. 9,155,388.

(30) Foreign Application Priority Data

Sep. 9, 2010 (GB) ..... 1015084.5

(51) Int. Cl.
*A61G 5/14* (2006.01)
*A47C 1/032* (2006.01)

(52) U.S. Cl.
CPC ..... *A61G 5/14* (2013.01); *A47C 1/032* (2013.01)

(58) Field of Classification Search
USPC ..... 297/330, 325, 340, DIG. 10, 84
See application file for complete search history.

(56) References Cited

U.S. PATENT DOCUMENTS 349,089 A * 9/1886 Gilbert ..... A61G 7/015 5/618
1,414,637 A 5/1922 Gell
(Continued)

FOREIGN PATENT DOCUMENTS

DE 297 15 343 11/1997
DE 29812763 7/1998
(Continued)

OTHER PUBLICATIONS

International Search Report for PCT/GB2010/001565 dated May 26, 2011, 6 pages.
(Continued)

*Primary Examiner* — David E Allred
(74) *Attorney, Agent, or Firm* — Andrew F. Young, Esq.; Lackenbach Siegel, LLP

(57) ABSTRACT

A lift-recliner chair includes a base section, movable seat and backrest sections and a powered actuator for relative moving the seat and backrest sections. The seat section is pivotally mounted with respect to the base section and the backrest is pivotally mounted with respect to the seat section. The base and seat sections each have a pair of side panels arranged substantially parallel with respect to each other on both sides of the chair with the actuator means enclosed in the interior region of the chair in all adjustment positions of the chair. The base and seat sections are arranged telescopically and moveable respect to the base section. The actuator has a first range of movement for moving the backrest with respect to the seat section and a second range of movement for moving the seat section and backrest with respect to the base.

22 Claims, 10 Drawing Sheets

(56) References Cited

U.S. PATENT DOCUMENTS

| | | | | | |
|---|---|---|---|---|---|
| 3,343,871 | A | | 9/1967 | Yates | |
| 3,873,152 | A | | 3/1975 | Garas | |
| 5,024,486 | A | * | 6/1991 | Auel | A61G 5/00 297/330 |
| 5,219,204 | A | * | 6/1993 | Bathrick | A47C 1/0355 297/321 |
| 5,366,036 | A | * | 11/1994 | Perry | A61G 5/006 180/6.5 |
| 5,466,046 | A | | 11/1995 | Komorowski et al. | |
| 5,641,201 | A | * | 6/1997 | Casey | A61G 5/14 297/326 |
| 5,785,384 | A | | 7/1998 | Sagstuen | |
| 5,806,920 | A | | 9/1998 | Blount | |
| 5,992,931 | A | * | 11/1999 | LaPointe | A47C 1/0345 297/330 |
| 6,000,758 | A | | 12/1999 | Schaffner et al. | |
| 6,702,378 | B2 | * | 3/2004 | Bullard | A61G 5/14 297/224 |
| 7,455,360 | B2 | * | 11/2008 | White | A47C 1/029 297/321 |
| 7,543,885 | B2 | * | 6/2009 | Pollard | A47C 1/0355 297/330 |
| 7,575,279 | B2 | | 8/2009 | Robertson | |
| 7,631,937 | B2 | * | 12/2009 | Robertson | A47C 1/0242 297/330 |
| 7,698,761 | B2 | * | 4/2010 | Neuenswander | A47C 20/041 5/611 |
| 7,699,389 | B2 | | 4/2010 | Robertson | |
| 9,241,571 | B2 | * | 1/2016 | Robertson | A47C 1/03294 |
| 9,358,167 | B2 | * | 6/2016 | LaPointe | A47C 31/008 |
| 2002/0063459 | A1 | | 5/2002 | Gaffney et al. | |
| 2002/0125751 | A1 | | 9/2002 | Bullard | |
| 2004/0155504 | A1 | | 8/2004 | Tada | |
| 2004/0212236 | A1 | | 10/2004 | Hale | |
| 2016/0120315 | A1 | * | 5/2016 | Robertson | A47C 1/03294 297/86 |

FOREIGN PATENT DOCUMENTS

| | | | | | |
|---|---|---|---|---|---|
| DE | 10 2007 024218 | | | 11/2008 | |
| EP | 0865960 | | | 9/1998 | |
| EP | 0 891 730 | | | 1/1999 | |
| EP | 1 050 248 | | | 11/2000 | |
| EP | 1 621 173 | | | 2/2006 | |
| GB | 1497973 | | | 4/1976 | |
| GB | 2227932 | | | 8/1990 | |
| GB | 2 380 399 | | | 4/2003 | |
| GB | 2 418 846 | | | 4/2006 | |
| GB | 2450199 | | | 12/2008 | |
| GB | 2485424 | | | 5/2012 | |
| GB | WO 2015044632 | A3 | * | 5/2015 | A47C 1/0242 |
| GB | 2520812 | A | * | 6/2015 | A47C 1/0242 |
| JP | 61 181562 | | | 11/1986 | |
| WO | WO 97/27832 | | | 8/1997 | |
| WO | WO 2005/051128 | | | 6/2005 | |
| WO | WO 2006/023447 | | | 3/2006 | |
| WO | WO2008/132482 | | | 11/2008 | |
| WO | WO 2011/048384 | | | 4/2011 | |
| WO | WO 2012/032305 | | | 3/2012 | |

OTHER PUBLICATIONS

Combined Search and Examination report for GB 1013879.0, dated Dec. 7, 2010 (6 pages).

International Search Report for PCT/GB2010/001961 dated Nov. 2, 2011, 2 pages.

PCT/GB2011/001329 International Search Report dated Feb. 2, 2012, 3 pages—English.

International Search Report and Written Opinion for PCT/GB2008/001504 dated Sep. 24, 2008.

U.S. Appl. No. 13/380,985, filed Feb. 2012, Robertson.

* cited by examiner

LIFT-RECLINER CHAIR

CROSS REFERENCE TO RELATED APPLICATIONS

This application relates to and is a continuation of U.S. Ser. No. 13/818,678 filed Apr. 29, 2013, the entire contents of which are incorporated by reference, which claims priority from PCT/GB/2011/001329 filed Sep. 9, 2011, the entire contents of which are incorporated herein by reference, which in turn claims priority to GB App. Ser. No. 1015084.5 filed Sep. 9, 2010.

This invention relates to powered lift-recliner chairs, and in particular concerns lift-recliner chairs of the type where the actuator and support arrangement for moving the adjustable parts of the chair is integrated into the structure of the chair.

Integrated lift-recliner chairs as disclosed in WO2005/051128 and WO2008/132482 typically comprise a number of relatively moveable sections including a floor standing base section, on angularly adjustable seat section, which is movable between a position in which it lies generally horizontally and a titled or inclined position in which it is raised to assist a user in moving from a seated position to a standing position, and an adjustable backrest section pivotally connected to the seat section. The chair further comprises an adjustable foot rest. The base and seat sections each include a pair of side panels arranged substantially parallel with each other on both sides of the chair to shield the actuator arrangement located in the interior of the chair. The base and seat sections are arranged in a telescopic nesting configuration such that the seat section is telescopically extendable from the base section to raise and lower the chair. Typically each adjustable section is provided with a dedicated powered actuator, usually an electrical linear actuator or jack, for moving that section relative to the other sections of the chair. In the lift recliner chair disclosed in FIG. 1 of WO2008/132482 the base and seat sections include respective actuator mounting brackets between which an actuator is mounted for moving the seat section relative to the base section about its pivot axis. Actuator mounting brackets are also provided on the seat section and the backrest between which a second actuator is mounted for moving the backrest relative to the seat section. In this arrangement and in the arrangements disclosed in WO2005/051128 the recliner function of the chair is provided by the operation of a dedicated actuator and the lift function is independently provided by a further dedicated actuator.

There is a requirement for an integrated type lift-recliner chair which has a simpler construction and reduced manufacturing costs compared with known designs.

According to an aspect of the present invention there is provided a lift-recliner chair comprising a floor standing base section, movable seat and backrest sections and actuator means for moving the seat and backrest sections, the seat section being pivotally mounted with respect to the base section and the backrest being pivotally mounted with respect to the seat section, characterised in that the said actuator means includes a single actuator for co-ordinated movement of both the seat and backrest sections.

According to another aspect of the invention there is provided a lift-recliner chair comprising a floor standing base section, movable seat and backrest sections and powered actuator means for moving the seat and backrest sections, the seat section being pivotally mounted with respect to the base section and the backrest being pivotally mounted with respect to the seat section, the base and seat sections each having a pair of side panels arranged substantially parallel with respect to each other on both sides of the chair with the actuator means being enclosed in the interior region of the chair between the side panels in all adjustment positions of the chair, the base and seat sections being arranged in a telescopic nesting configuration such that the seat section is telescopically moveable with respect to the base section to raise and lower the chair, characterised in that the said actuator means includes a single actuator for co-ordinated movement of both the seat and backrest sections.

Preferably, the single actuator has a first range of movement for moving the backrest with respect to the seat section to provide the recliner function of the chair and a second range of movement for moving the seat section and backrest with respect to the base to provide the lift function of the chair.

The above aspects of the present invention are particularly advantageous as they employs only a single actuator, such as a powered motor or gas strut or spring for both the lift and recline functions of the chair. This reduces the cost of the chair significantly compared with prior art arrangements where two dedicated actuators are provided for the two separate functions of the chair. Thus there is a significant saving in manufacturing costs which affords wider appeal in the marketplace for the aforementioned type of lift-recliner chair.

Preferably, the first and second ranges of movement are contiguous. In this way the second range of movement immediately follows the first.

In preferred embodiments movement of the actuator means in the first range exclusively moves the backrest with respect to the seat and base to provide the recliner function, and movement of the actuator means in the second range exclusively moves the seat and backrest with respect to the base to provide the said lift function. In this way there is a definite and immediate transition between recline and lift functions when the actuator is energised through its full range of movement, with the actuator acting either exclusively to recline the backrest or exclusively to lilt the seat section.

Preferably, movement of the backrest with respect to the seat section is unfettered in the first range of movement. Movement of the backrest in the second range of movement is preferably prevented by engagement of respective engagement parts of the backrest and seat sections. This provides a simple mechanical arrangement by which the two functions of the lift-recliner chair can be divided.

Preferably, the engagement parts engage by mutual abutment as the actuator means moves from the first range to the second range, and the engagement parts disengage as the actuator moves from the second range to the first. In this way engagement and disengagement is simply and conveniently effected at the transition between the first and second ranges of the actuator movement.

At least one of the side panels of the seat section may include a slot which accommodates an engagement part of the backrest, which engagement part moves freely in the slot through the first range of movement and engages an abutment end of the slot at the transition between the first and second ranges of movement. This provides a simple and compact arrangement for the purpose of providing both the lift and recline functions of the chair. In preferred embodiments slots are provided in each of the respective seat section side panels for engagement with respective backrest engagement parts. In this way the loads applied to the backrest and seat sections by the actuator means can be readily applied on both sides of the chair.

Preferably the backrest includes a cross-member which extends between and through the slots, with the ends of the cross-member being accommodated in the respective slots. In this way the ends of the cross-member provide the backrest engagement parts on the sides of the choir.

The actuator is a preferably a linear actuator. Actuator loads can be minimised by selective placement of a linear actuator to maximise the turning moment applied to the movable sections of the chair.

In preferred embodiments the actuator is connected at one end to the base and at the other end to the backrest. The actuator thus provides a connection between the base and the backrest.

The linear actuator maybe connected to the backrest cross-member. This readily enables actuator load to be applied first to the backrest in its first range of movement and then to the seat section, via engagement of the seat section with the backrest, in the second range of movement.

In preferred embodiments the base section, including the respective base side panels, provides an outer frame of the choir and the seat section, including the respective seat side panels, on inner frame. In this way the seat frame nests within and is telescopically extendable from the base. Aspects of the present invention also contemplate embodiments where the base section constitutes the inner frame and the seat section the outer frame.

Preferably, the backrest is pivotally connected directly to the side panels of the seat section.

The side panels of the seat section are pivotally connected to the base, preferably the side panels of the base, preferably by guide means including at least one guide associated with one of the seat or base and at least follower associated with the other of the seat and the base. In other embodiments the side panels of the seat section may be pivotally connected to the side panels of the base by means of respective pivot pins, etc as shown in WO2005/051128.

Various embodiments of the present invention will now be more particularly described, by way of example only, with reference to the accompanying drawings, in which.

In the drawings the same reference numbers are used for same or similar parts.

Referring now to FIGS. 1-6 which show the structural arrangement and moving parts of a lift-recliner chair arrangement according to an embodiment of the present invention.

Figure 1:
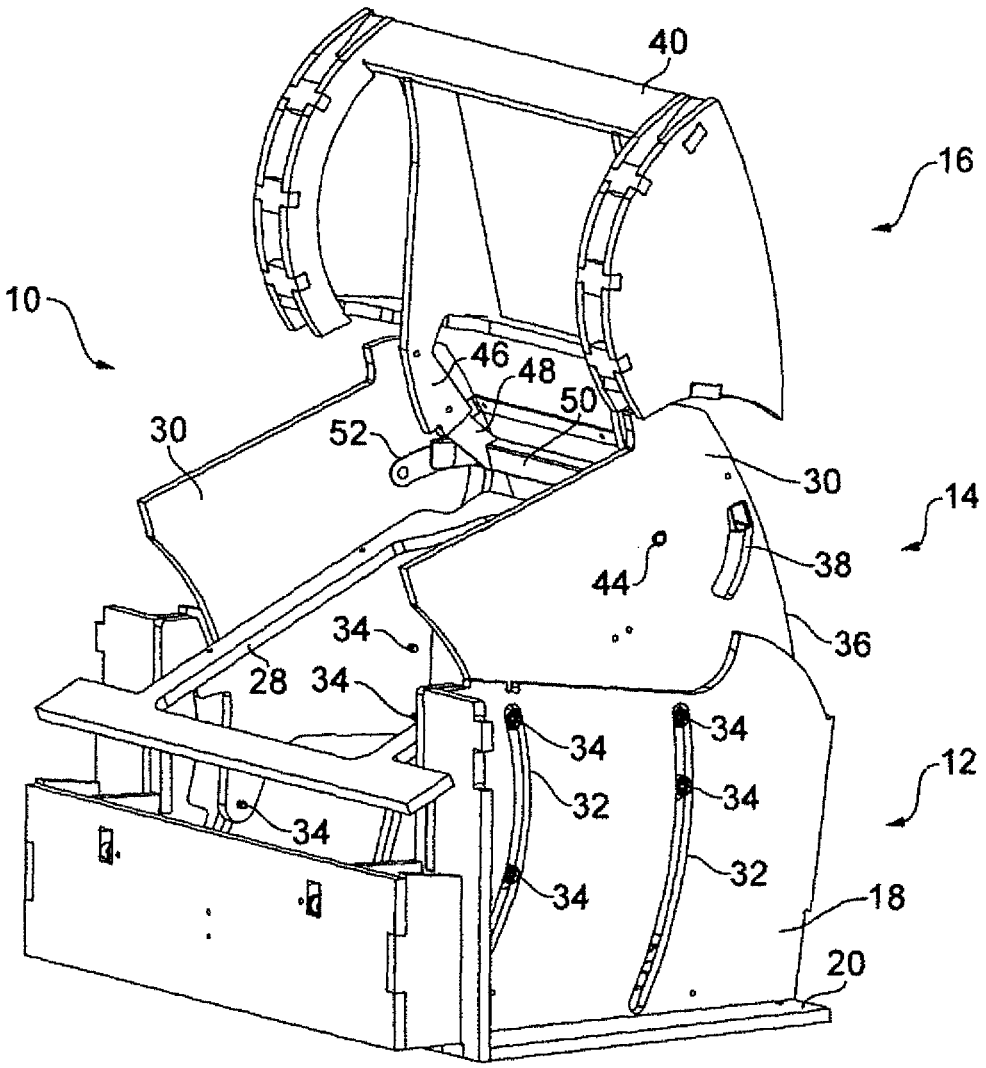
FIG. 1 is perspective view from the front of a lift-recliner chair frame according to on embodiment of the present invention, with the chair frame shown in a fully raised position.

FIG. 1 is a perspective view of the structural frame 10 of a lift-recliner chair according to an embodiment of the present invention. The frame is constructed principally from board material of the type typically used in the furniture industry, for example MDF or engineering board which is readily machinable on a CNC router or the like.

The frame 10, and hence the chair, includes a base support section 12, a seat support section 14, and a backrest section 16. The base section includes a pair of lateral side panels 18 and a rear panel (not shown) extending between the side panels at the rear of the chair. The base section 12 constitutes the floor standing part of the chair and includes a pair of chassis legs in the form of elongate members 20 which extend parallel to each other on the lateral (left and right hand) sides of the chair. The elongate members 20 are attached to the respective side panels 18 at the lower edges 22 thereof and extend outwards perpendicularly therefrom. The chassis legs 20 constitute floor support members to which castors or the like may be attached for contact with the floor on which the chair is positioned. The chassis legs are preferably constructed from the same board material as the rest of the frame 10.

Figure 2:
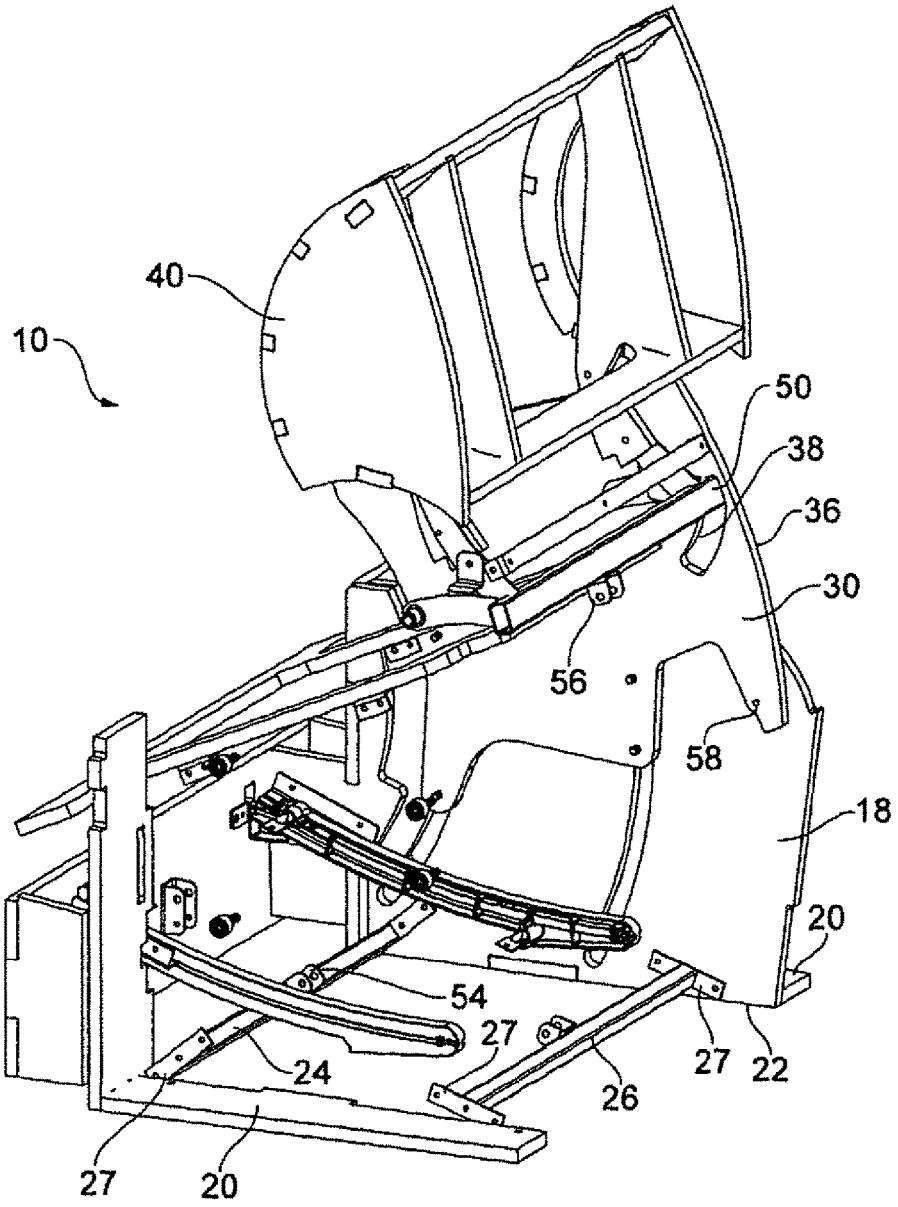
FIG. 2 is a perspective view from the rear of the chair frame of FIG. 1 with various side panels omitted for illustrative purposes.
Figure 3:
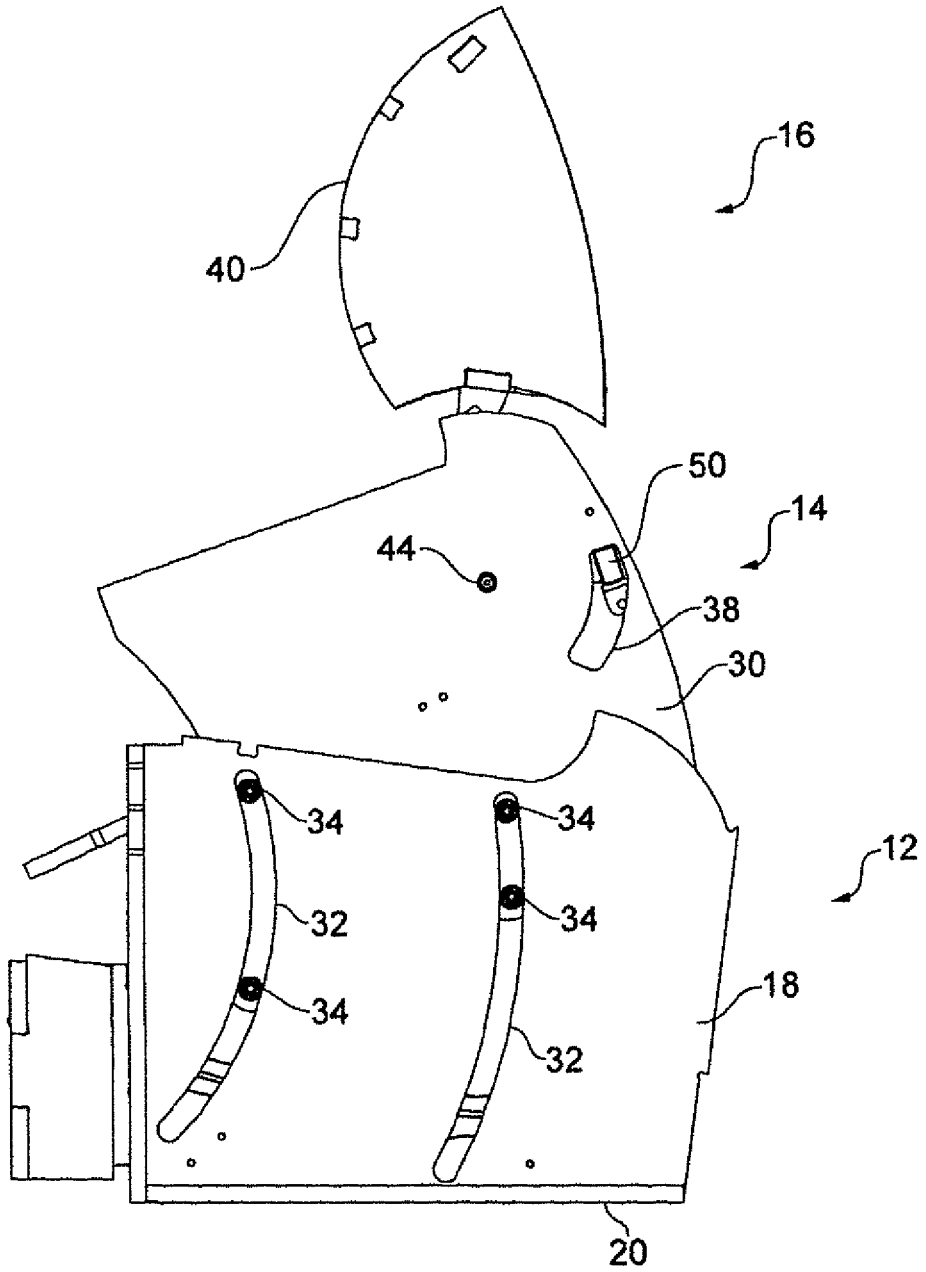
FIG. 3 is a side view of the chair of FIG. 1.
Figure 4:
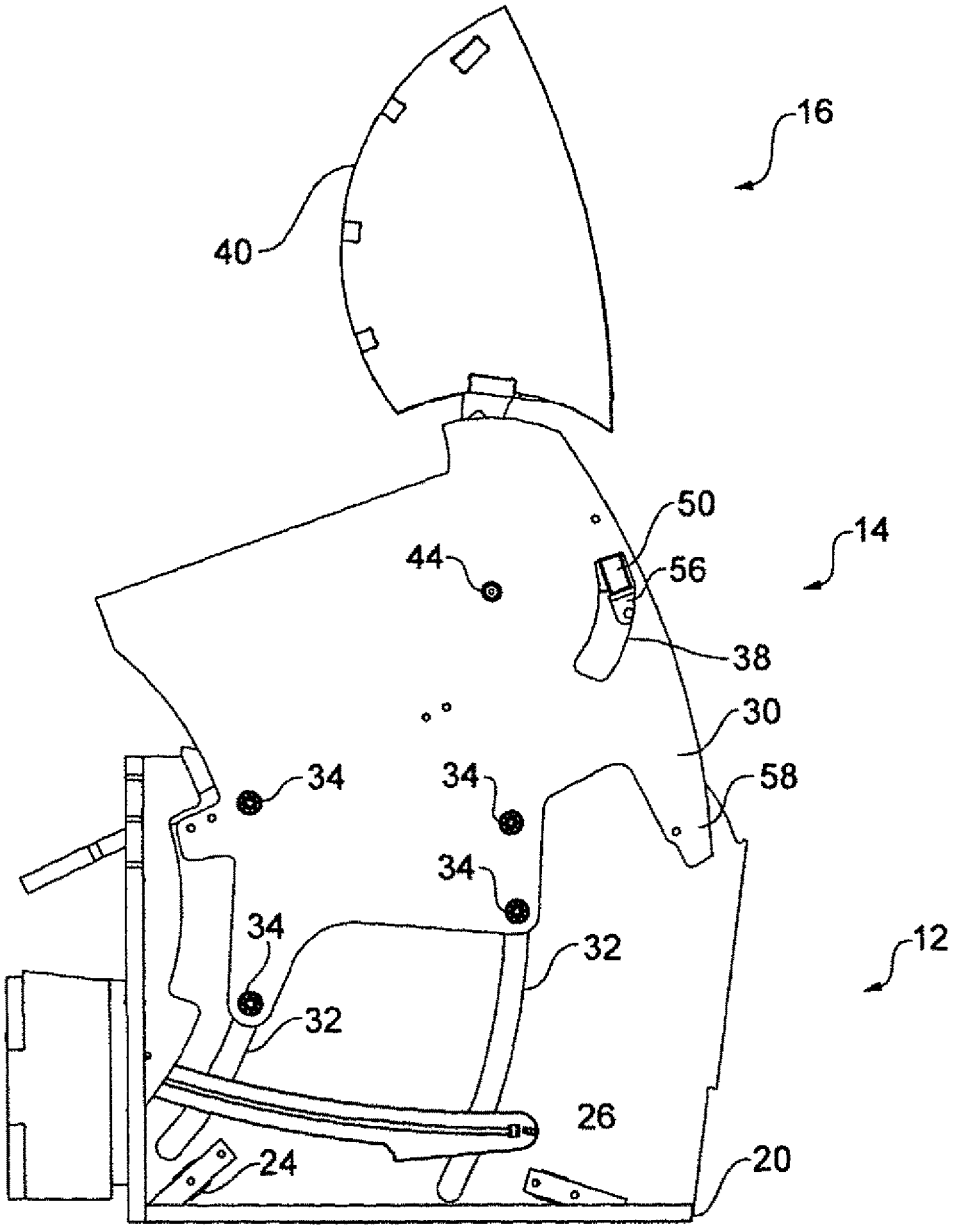
FIG. 4 is a side view similar to FIG. 3 with a base section side panel omitted.

The side panels 18 are connected together at the front and rear of the chair by front and rear cross-members 24 and 26 which extend between the panels in the region of the panel bottom edges 22, as can best be seen in FIG. 2. The cross-members 24 and 26 are of tubular metal construction and are provided with perpendicular mounting flanges 27 for attachment to the respective side panels 18, typically by means of suitable fasteners such as screws or the like.

The side panels 18, rear panel, elongate chassis legs 20 and cross-members define an outer open box like structure for supporting other parts of the chair.

The seat section 14 comprises a similar box type structure constructed primarily of board material and comprising a generally rectangular hollow frame 28 and a pair of lateral side panels 30. The seat frame 28 supports the seat pad (not shown) of the chair in a manner well known to those skilled in the art. The lateral sides of the frame 28 are connected to the respective lateral side panels by suitable fixing means such as screws or the like.

The seat section 14 nests with the base section 12 and is pivotally connected thereto by a series of guides and followers in a similar manner to the arrangements disclosed in WO2005/132481, the contents of which are incorporated herein by reference. Arcuate guide slots 32 are provided in the panels 18 and the slots receive a pair of spaced followers in the form of rollers 34 which are rotatably mounted on the adjacent seat section side panels 30, extending on the outward facing side thereof. The rollers are free to run in the guide slots 32.

The pivot axis of the seat section is defined by the centre of curvature of the concentric slots 32. The rear edges 36 of the seat section side panels 30 are arcuate and have a centre of curvature coincident with the centre of curvature of the slots 32 so that the rear part of the seat section can move freely, and in close proximity to, the rear panel (not shown) of the base section when the seat section is moved relative to the base section. Similarly, an end panel (not shown) which may be attached to the rear of the seat section at the rear edges 36 will also have a curvature which follows the curvature of the edges 36 so that the rear of the chair is enclosed by the seat section and base section end panels.

It will be understood that the width dimension of the seat section is slightly less than the width dimension of the base section so that the seat section nests within the base section and is extendable thereform when pivoted about its pivot axis to the raised position shown in FIGS. 1 to 4. In this respect the base section may be considered to comprise the outer frame of the chair and the seat section the inner frame of the nesting arrangement. The present invention contemplates embodiments where the seat section forms the outer frame and the base section the inner frame.

The side panels 30 are each provided with a single accurate slot 38 positioned in the panel towards the rear edge 36. The purpose of this slot is significant to the understanding of the illustrated embodiment of the present invention and will be discussed in more detail below in relation to the operation of the backrest 16 and the lifting function of the chair.

The backrest 16 is constructed as a knock down type including a removable shaped frame 40 which is attached to connecting parts 42 of a pivot mounting arrangement which pivotally connects the backrest to the seat section at 44. The removable shaped frame is typical of a removable knock down backrest used in the furniture industry having female connecting parts 46 which receive corresponding male connecting parts or brackets 48 of the pivot mounting arrangement.

The pivot mounting arrangement is preferably of metal construction and comprises a tubular cross-member 50 which extends across the width of the chair with its ends disposed in the respective slots 38. The cross-member is disposed perpendicular to the side panels 30 and is pivotally connected to the respective side panels by a pair of lever arms 52 which extend parallel with the side panels 30 adjacent the interior facing surfaces thereof. The levers are each provided with an upstanding pin which is received in a mounting bore in the side panel at 44 to pivotally connect the backrest to the movable seat section. As can best be seen in the drawing of FIG. 1, the connecting brackets 48 are positioned slightly inboard of the levers 52 on the cross-member 50. The cross-member 50, lever arms 52 and connecting brackets 48 thus form a rigid structure and are preferably of metal construction joined together by welding.

An electrical linear actuator (jack) 53, as shown in the drawings of FIGS. 7 to 10 but omitted from the drawings of FIGS. 1-6, is connected between the base section cross-member 24 and the backrest section cross-member 50. The linear actuator is connected at one end to mounting bracket 54 midway along the cross-member 24 and connected at the other end to mounting bracket 56 midway along the cross-member 50 such that extension and retraction of the actuator causes the backrest to be pivoted about its pivot axis and the seat section to be lifted.

Figure 5:
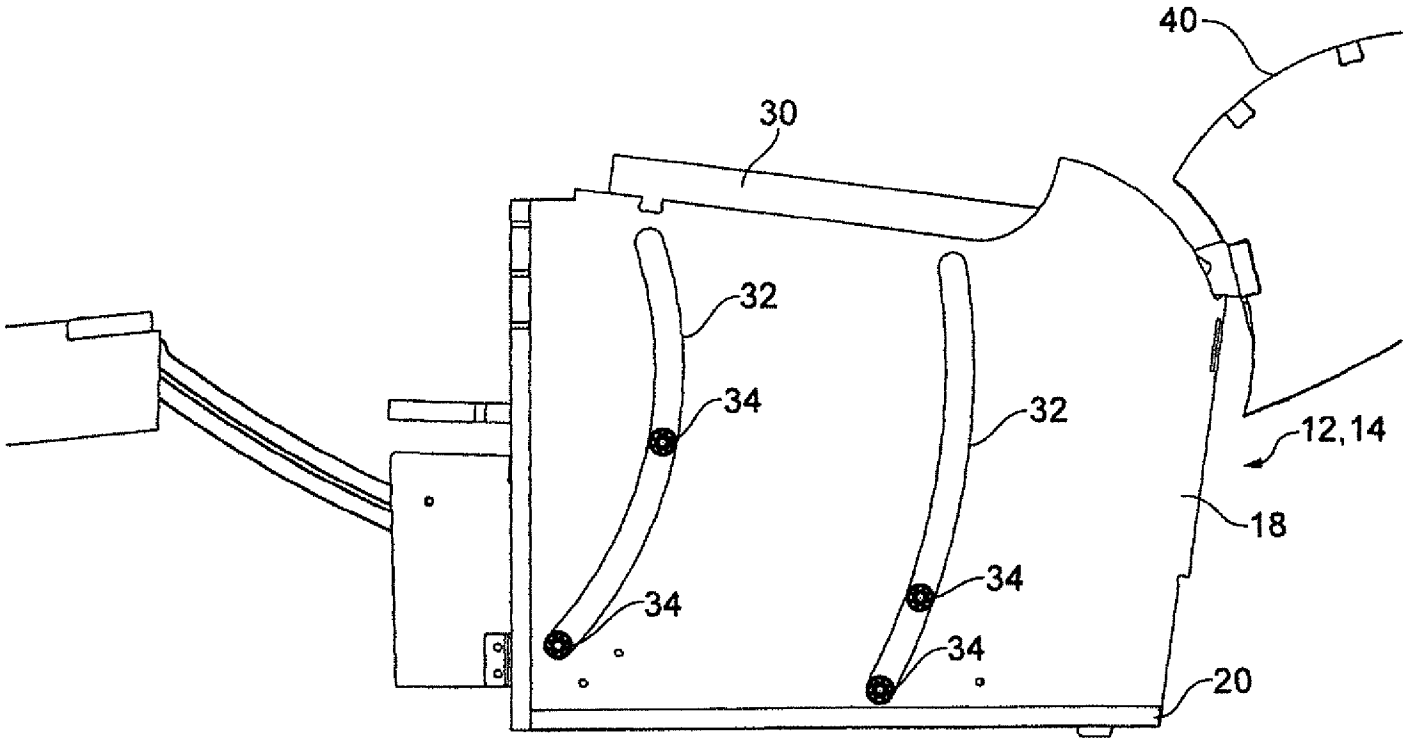
FIG. 5 is a partial side view of the chair frame, similar to FIG. 3, with the choir in its fully reclined position.
Figure 6:
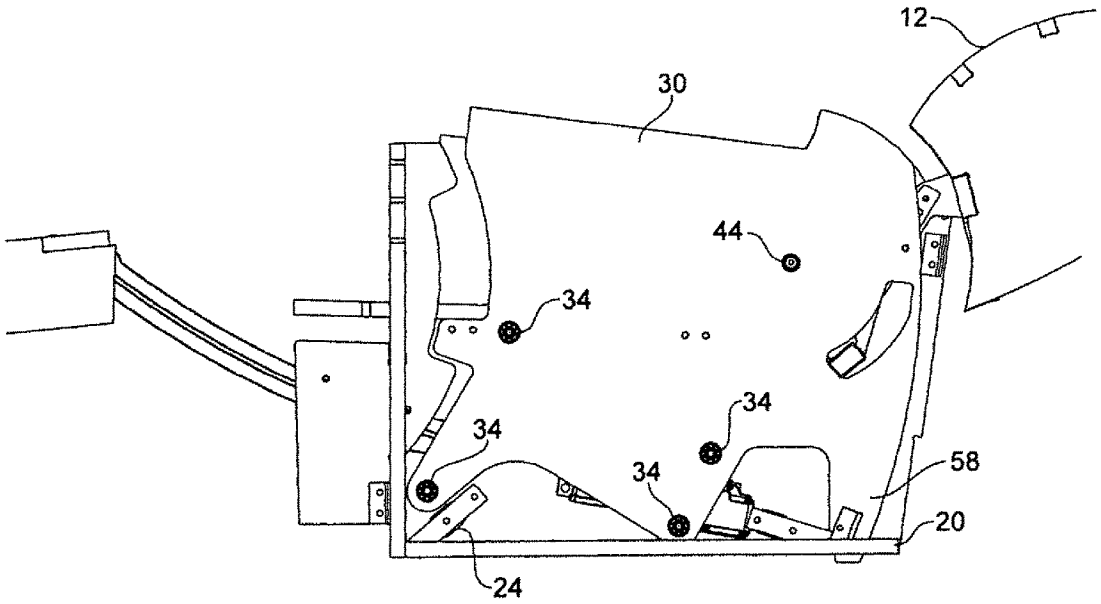
FIG. 6 is a partial side view of the chair frame, similar to FIG. 4, with the chair in its fully reclined position.
Figure 7:
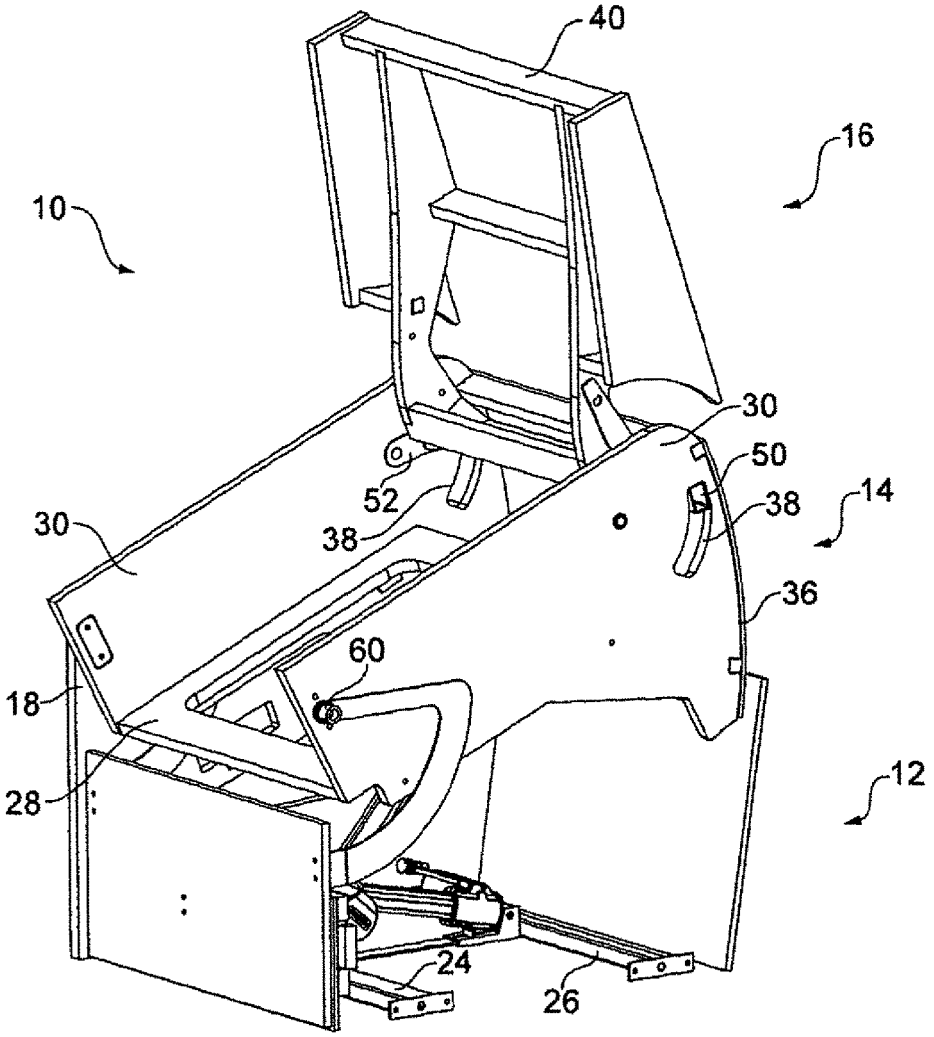
FIG. 7 is a perspective view from the front of a lift-recliner chair frame according to another embodiment of the present invention, with the frame shown in a fully raised position, with a side panel omitted for illustrative purposes only.

In the drawings of FIGS. 1 to 4 the chair is fully raised to its lift position. In this position the single linear actuator 53 is at full extension. In this position the ends of the cross-member 50 abut the respective ends of the slots 38. As the actuator is retracted the seat section is lowered as it moves about its pivot axis until a lower leg part 58 of the side panels contacts the cross-member 26 which prevents further movement of the seat section with respect to the base. Further retraction of the linear actuator effects movement of the backrest about its pivot axis to recline the backrest with respect to the base and seat section to the fully reclined position shown in FIGS. 5 and 6. In this way it will be understood that the actuator has two ranges of movement, first from a fully retracted condition where the backrest is fully reclined, as shown in FIGS. 5 and 6, to an intermediate extension position where the backrest is moved to an upright position by movement of the cross-member 50 in the slots 38, and a second range of movement from the aforementioned intermediate position to a fully extended position which causes the seal section to rotate about its pivot axis due to abutting engagement of the ends of the cross member with the ends of the slots 38 from the intermediate extension position onwards. Thus, the linear actuator connected between the cross-member mounting brackets 54 and 56 provides the necessary force and hence motion for moving the backrest with respect to the seat and base sections to provide the recliner function and subsequently to move the backrest and seat section with respect to the base section to provide the lift function.

Referring now to the drawings of FIGS. 7 to 10, in a second embodiment of the present invention the lift-recliner chair is of the type described in WO2005/051128, the contents of which are incorporated herein by reference. The lift-recliner chair of FIGS. 7 to 10 is substantially the same as that shown in FIGS. 1 to 6 apart from the pivot mounting arrangement between the seat section and the base section of the chair. In the second embodiment the seat section is pivotally connected to the base section by pivot pins 60 extending orthogonally from the side panels 30 of the seat section into receiving bores in the respective side panels 18. As can be seen in the drawings of FIGS. 7 to 10 the pivot pins 60 define the pivot axis of the seat section and are positioned towards the front edge 62 of the side panels. In this embodiment the pivot axis of the seal section is defined within the area of the side panels 18, 30 whereas in the pivot arrangement of FIGS. 1 to 6 the pivot axis is not so constrained which allows the finished item of furniture to have a slightly different overall shape such as scalloped arms and a T-section seat cushion, for example, design features that are well known in the furniture industry.

Figure 8:
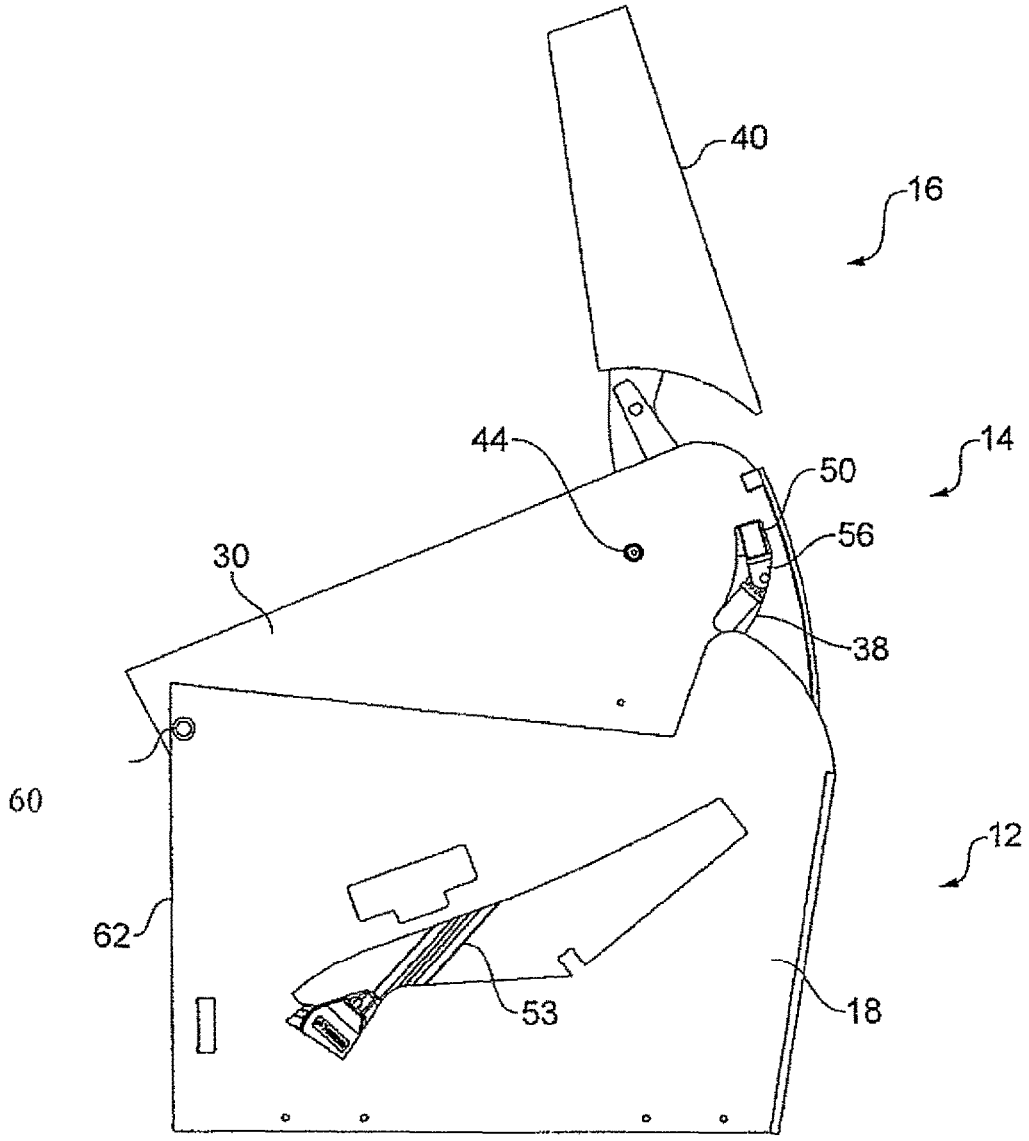
FIG. 8 is a side elevation view of the chair frame of FIG. 7 with all side panels attached.
Figure 9:
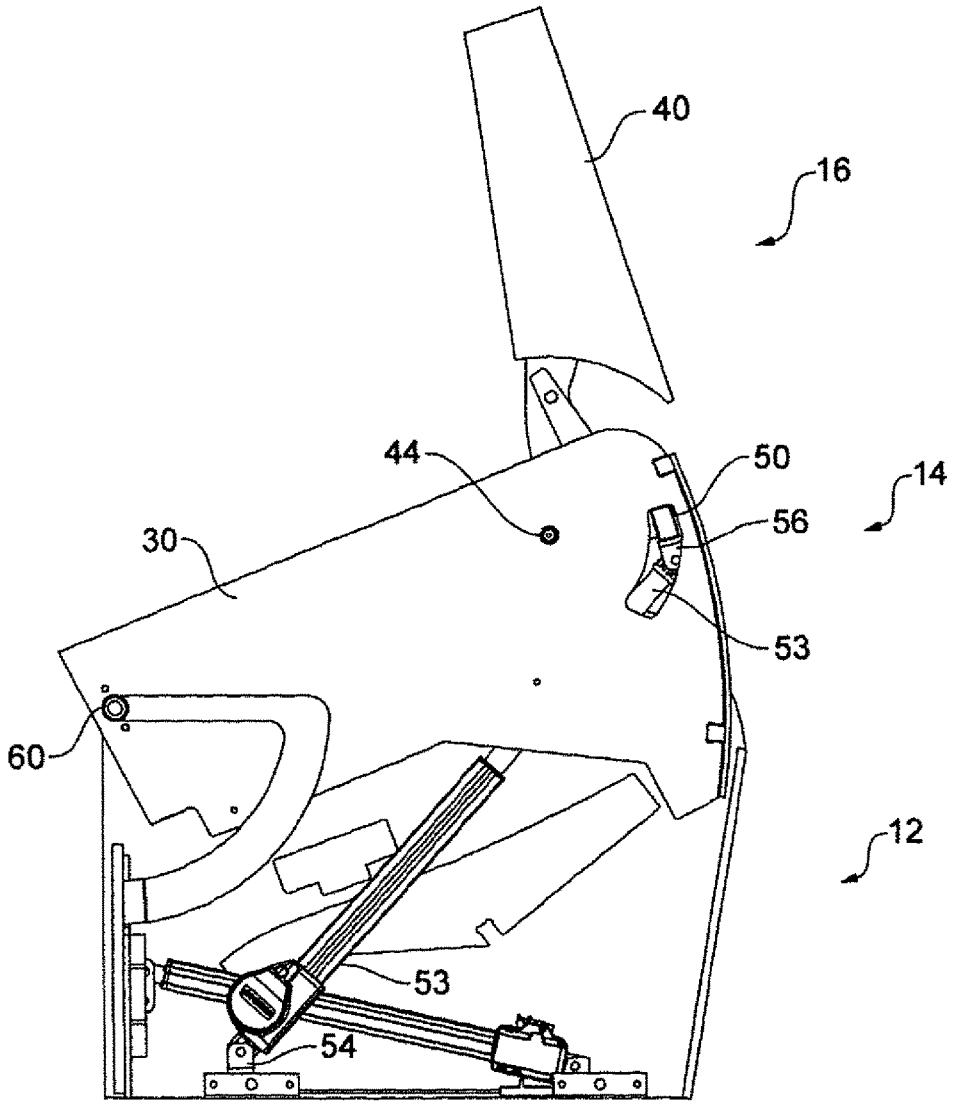
FIG. 9 is side elevation view identical to FIG. 8 but with the base section side panel omitted.
Figure 10:
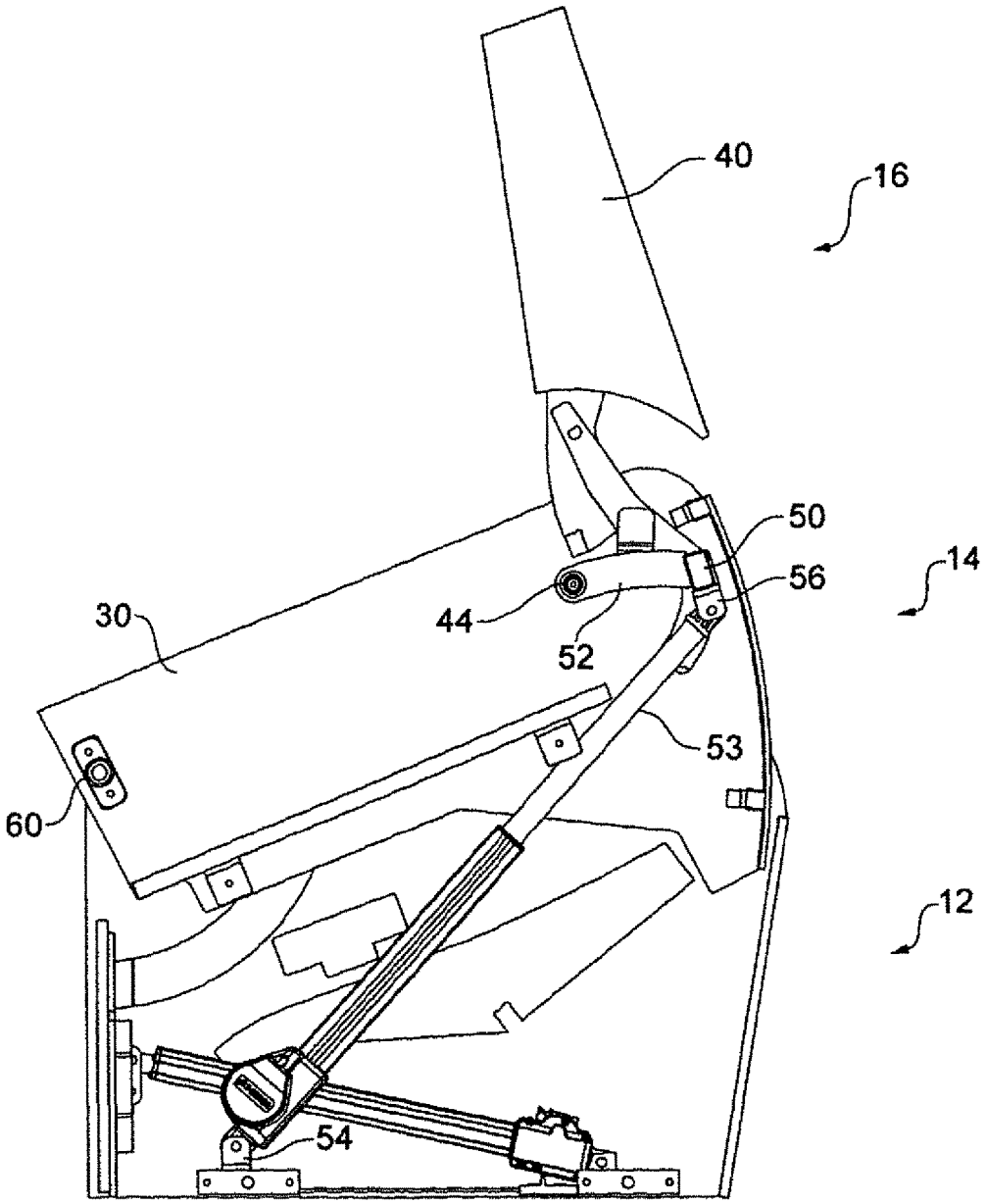
FIG. 10 is a side elevation view identical to FIG. 9 with both the seat and base section side panels omitted.

In the drawings of FIGS. 7 to 10 the linear actuator 53 is present and connected between the brackets 54 and 56. The chair frame is shown in its fully raised position with the actuator 53 at full extension as previously described. The side elevation drawings of FIGS. 8, 9 and 10 show the chair frame in progressively more detail with the side panels 18 and 30 progressively removed (omitted from the drawing) to reveal the internal detail of the chair. FIG. 8 is a side view of the chair in its fully raised position with the side panels 18 and 30 in place. FIG. 9 is a similar side view of the choir with the base section side panel 18 omitted for clarity to reveal the internal detail of the chair including the lower part of the actuator 53 attached to the bracket 54. FIG. 10 is a similar side view but with the seat section side panel 30 also removed showing the whole of the liner actuator 53 in its fully extended position.

The invention claimed is:

1. A lift-recliner chair comprising:

a floor standing base section, a movable seat section and a movable backrest section and actuator means for moving the seat and backrest sections;

the seat section being pivotally mounted with respect to the base section and the backrest section being pivotally mounted with respect to the seat section;

wherein said actuator means is a single actuator for operative co-ordinated movement of both the seat and backrest sections, the single actuator being connected at one end to the base section and at the other end to the backrest section;

wherein an operative movement of the backrest section with respect to the seat section is unfettered in a first range of movement and is prevented in a second range of movement by a positive engagement of respective engagement parts of the backrest and seat sections, said engagement parts including at least a first engagement part fixed in relation to the seat section; and wherein the engagement parts comprise ends of respective slots in the seat section and respective followers on the backrest section, and wherein the single actuator is connected to the backrest section, at least in part, through the respective followers such that the first range of movement comprises movement of the followers in the slots during movement of the backrest section relative to the seat section, and the second range of movement comprises movement of the backrest section and the seat section together relative to the base section when a force from the single actuator is applied to the ends of the slots via the followers.

2. A lift-recliner chair as claimed in claim 1, wherein:

said engagement parts include a second engagement part fixed in relation to the backrest section.

3. A lift-recliner chair as claimed in claim 1, wherein:

the single actuator has said first range of movement operative for moving the backrest section with respect to the seat section to provide a recliner function of the chair and said second range of movement operative for moving the seat section and backrest section with respect to the base section to provide a lift function of the chair.

4. A lift-recliner chair as claimed in claim 3, wherein:

the said first and second ranges of movement are contiguous.

5. A lift-recliner chair as claimed in claim 1, wherein:

a movement of the actuator means in said first range exclusively moves the backrest section with respect to the seat section and base section to provide said recliner function and movement of said actuator means in said second range exclusively moves the seat section and backrest section with respect to the base section to provide said lift function.

6. A lift chair as claimed in claim 1, wherein:

said engagement parts engage by mutual abutment as said actuator means moves from said first range to said second range, and said engagement parts disengage on a reverse transition thereof.

7. A lift-recliner chair as claimed in claim 1, wherein:

at least part of the seat section is provided with a slot which accommodates at least one of the engagement parts of the backrest section, which engagement part moves freely in the slot through the said first range of movement and engages an abutment end of the slot at a transition between said first and second ranges of movement.

8. A lift-recliner chair as claimed in claim 7, wherein:

slots are provided in respective seat section side panels and operative for engagement with respective backrest section engagement parts of the engagement parts.

9. A lift-recliner chair as claimed in claim 8, wherein:

said backrest section includes a cross-member which extends between said slots with the ends of the cross-member being accommodated in the respective slots operative to provide said backrest section engagement parts on both sides of the chair.

10. A lift-recliner chair as claimed in claim 1, wherein:

the said actuator is a linear actuator.

11. A lift-recliner chair as claimed in claim 10, wherein:

said actuator is secured at one end with respect to the said base section and at the other end with respect to the backrest section.

12. A lift-recliner hair as claimed in claim 10, wherein:

the said linear actuator is connected to the said backrest section cross-member.

13. A lift-recliner chair as claimed in claim 1, wherein:

the base and seat sections each have a pair of side panels arranged substantially parallel with respect to each other on both sides of the chair with the actuator means being enclosed in the interior region of the chair between the side panels in all adjustment positions of the chair, the base and seat sections being arranged in a telescopic nesting configuration such that the seat section is telescopically moveable with respect to the base section to raise and lower the chair.

14. A lift-recliner chair as claimed in claim 13, wherein:

said base section, including the respective base section side panels, provides an outer frame of the chair and the seat section, including the respective seat section side panels, an inner frame, such that the seat frame nests within and is telescopically extendable from the base section.

15. A lift-recliner as claimed in claim 13, wherein:

the backrest section is pivotally connected to the side panels of the seat section.

16. A lift-recliner as claimed in claim 13, wherein:

the side panels of the seat section are pivotally connected to the base section proximate said side panels by guide means; and said guide means including at least one guide associated with one of the seat and the base sections and at least follower associated with the other of the seat and the base sections.

17. A method for operating a lift-recliner chair, comprising the steps of:

providing a floor standing base section, a movable seat section and a movable backrest section and operatively engaging an actuator means for moving the seat and backrest sections;

pivotally mounting the seat section with respect to the base section and pivotally mounting the backrest section with respect to the seat section;

providing in said actuator means a single actuator for operative co-ordinated movement of both the seat and backrest sections, the single actuator being connected at one end to the base section and at the other end to the backrest section; and operating a movement of said backrest section with respect to the seat section in an unfettered manner through a first range of movement and preventing movement in a second range of movement by an engagement of respective engagement parts of the backrest and seat sections during a use thereof; and providing said engagement parts with a first engagement part fixed in relation to the seat section; and wherein the engagement parts comprise ends of respective slots in the seat section and respective followers on the backrest section, and wherein the single actuator is connected to the backrest section, at least in part, through the respective followers such that the first range of movement comprises movement of the followers in the slots during movement of the backrest section relative to the seat section, and the second range of movement comprises movement of the backrest section and the seat section together relative to the base section when a force from the single actuator is applied to the ends of the slots via the followers.

18. A method, as claimed in claim 17, further comprising the step of:

providing said engagement parts with a second engagement part fixed in relation to the backrest section;

the single actuator having said first range of movement operative for moving the backrest section with respect to the seat section to provide a recliner function of the chair and said second range of movement operative for moving the seat section and backrest section with respect to the base section to provide the lift function of the chair; and the said first and second ranges of movement are contiguous during a use thereof.

19. A method, as claimed in claim 18, comprising the steps of:

providing a pair of side panels on each of the base and seat sections each arranged substantially parallel with respect to each other on both sides of the chair;

enclosing said actuator means in an interior region of the chair between the side panels in all adjustment positions of the chair;

arranging the base and seat sections in a telescopic nesting configuration such that the seat section is telescopically moveable with respect to the base section to raise and lower the chair during said use;

providing an outer frame of said chair with said base section including respective base section side panels;

providing an inner frame of said chair with said seat section including respective seat section side panels, such that the inner frame nests within and is telescopically extendable from the outer frame;

pivotally connecting the backrest section to the side panels of the seat section;

pivotally connecting the side panels of the seat section to the base section proximate said side panels by guide means; and providing said guide means including at least one guide associated with at least one of said seat and said base sections and at least one follower associated with the other of said seat and said base sections during said use.

20. A lift-recliner chair chair comprising:

a floor standing base section;

a movable seat section;

a backrest section; and an actuator means for moving the seat and backrest sections, the seat section being pivotally mounted with respect to the base section;

the backrest section being pivotally mounted with respect to the seat section;

said actuator means being a single actuator for operative co-ordinated movement of both the seat section and the backrest section;

an operative movement of the backrest section with respect to the seat section being unfettered in a first range of movement and being prevented in a second range of movement by a positive engagement of respective engagement parts of the backrest section and the seat section;

at least part of the seat section being provided with a slot accommodating at least one of the engagement parts of the backrest section, said engagement part moving freely in the slot through said first range of movement and engaging an abutment end of the slot at a transition between said first and second ranges of movement.

21. A lift-recliner chair as claimed in claim 20, wherein:

slots are provided in respective seat section aside panels and operative for engagement with respective backrest section engagement parts of the engagement parts.

22. A lift-recliner chair as claimed in claim 20, wherein:

said backrest section includes a cross-member which extends between said slots with the ends of the cross-member being accommodated in the respective slots operative to provide said backrest section engagement parts on both sides of the chair.

* * * * *